United States Patent [19]

Konose

[11] Patent Number: 4,978,242

[45] Date of Patent: Dec. 18, 1990

[54] BRUSH TIP OF LIQUID APPLICATOR AND METHOD FOR PRODUCING THE SAME

[75] Inventor: Yoshiomi Konose, Fujioka, Japan

[73] Assignee: Mitsubishi Pencil Co., Ltd., Tokyo, Japan

[21] Appl. No.: 352,669

[22] Filed: May 9, 1989

Related U.S. Application Data

[63] Continuation of Ser. No. 19,393, Feb. 26, 1987, abandoned.

[30] Foreign Application Priority Data

Feb. 27, 1986 [JP] Japan ..... 61-43616

[51] Int. Cl.[5] ..... A46B 11/00

[52] U.S. Cl. ..... 401/129; 401/290; 401/199; 15/159 R; 15/171

[58] Field of Search ..... 401/196, 171, 206, 272, 401/273, 199, 126, 129, 130, 290; 267/69, 70, 141, 141.1, 153, 182; 15/159 R, 171, 173, 174, 187, 188, 159 A

[56] References Cited

U.S. PATENT DOCUMENTS

| | | | |
|---|---|---|---|
| 257,312 | 5/1882 | Gaynor et al. | 401/273 |
| 1,219,054 | 3/1917 | Timmis | 15/192 |
| 2,672,640 | 3/1954 | Peterson et al. | 15/159 A |
| 2,729,443 | 1/1956 | Olinger | 267/141 |
| 2,783,490 | 3/1957 | Kutik | 15/167 R X |
| 2,819,482 | 1/1958 | Applegate | 15/167.1 |
| 3,035,299 | 5/1962 | Gordon et al. | 401/273 X |
| 3,103,680 | 9/1963 | Krichmar | 15/167 R |
| 3,144,247 | 8/1964 | Szonn et al. | 267/141 X |
| 3,331,094 | 7/1967 | Schwartzman | 401/272 X |
| 3,604,043 | 9/1971 | Lewis, Jr. | 15/159 A |
| 3,680,169 | 8/1972 | Thompson | 15/167 R X |
| 4,325,902 | 4/1982 | Holding | 15/159 A X |
| 4,565,205 | 1/1986 | Taylor | 15/159 A X |

FOREIGN PATENT DOCUMENTS

| | | | |
|---|---|---|---|
| 46116 | 8/1910 | Austria | 401/273 |
| 3851 | of 1906 | United Kingdom | 401/183 |

*Primary Examiner*—Richard J. Apley
*Assistant Examiner*—D. F. Crosby
*Attorney, Agent, or Firm*—Armstrong, Nikaido, Marmelstein, Kubovcik & Murray

[57] ABSTRACT

A brush tip of a liquid applicator is provided with a predetermined thickness flange at its rear end, which flange is provided with a plurality a multiplicity of predetermined length projections at its rear surface, which projections are easily elastically deformable and disposed in a position opposite to that of a fibrous part of the brush tip. A method for producing such bruch tip of the liquid applicator is characterized by the use of a heating platen provided with a plurality of small holes at its front surface, in which small holes is inserted a part of a rear end portion of the brush tip and metled to form a plurality of projections while the remaining rear end portion of the brush tip is melted to form a flange.

1 Claim, 2 Drawing Sheets

FIG. 1-A
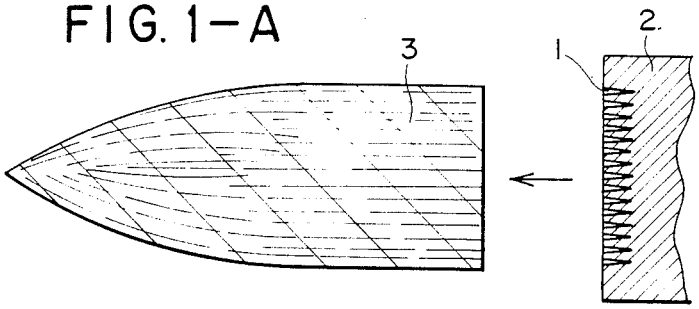
FIG. 1-B
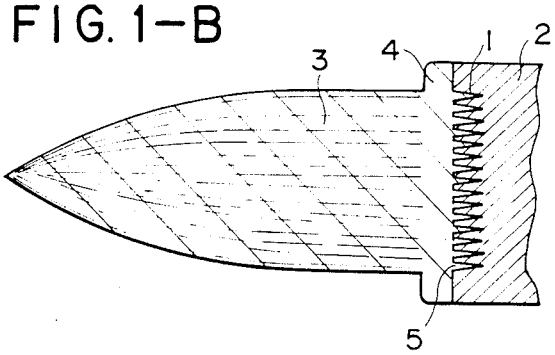
FIG. 1-C
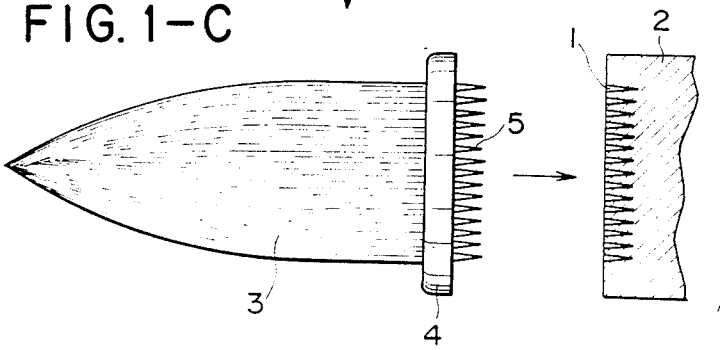

BRUSH TIP OF LIQUID APPLICATOR AND METHOD FOR PRODUCING THE SAME

This application is a continuation of application Ser. No. 019,393 filed Feb. 26, 1987, now abandoned.

BACKGROUND OF THE INVENTION

1. Field of the Invention

The present invention relates to a brush tip of a liquid applicator and a method for producing the brush tip such as a writing brush-core of a pen type writing brush and like writing instruments, or a painting brush tip of a liquid-cosmetic such as a nail polish applicator and the like.

2. Description of the Prior Art

As shown in FIG. 3, in a conventional type of a liquid applicator, a brush tip is constructed of a fiber bundle 3' a rear end portion of which is welded and solidified to form a flat plate-like flange 4' having a predetermined thickness. The thus formed conventional brush tip is fixed to a liquid applicator by being clamped at its flange 4' by means of a separate member provided in the liquid applicator while abutted at its flange 4' on a shoulder portion provided inside a front shaft of the liquid applicator. Consequently, if the thickness of the flange 4' varies, the thus fixed brush tip comes loose.

As described in the above, since the flange 4' is formed by melting and solidifying the rear end portion of the therefor 3', it is considerably hard to keep the thickness of the flange 4' constant.

SUMMARY OF THE INVENTION

It is an object of the present invention to provide a brush tip of a liquid applicator and a method for producing the brush tip which can be fixed to the liquid applicator in a secure manner without any loose motion even when the thickness of a flange of the brush tip varies.

According to one aspect of the present invention, there is provided: in a brush tip of a liquid applicator, provided with a predetermined thickness flange at its rear end, the improvement wherein: the brush tip of said liquid applicator is provided with a plurality or multiplicity of predetermined length projections at a rear surface of the flange opposite to a front surface of the flange, in which front surface a fibrous part of the brush tip is disposed, which projections are easily elastically deformed.

Further, according to another aspect of the present invention, there are provided: a method for producing a brush tip of a liquid applicator, comprising the steps of: abutting on a rear portion of a fiber bundle a heating platen provided with a plurality of small holes at its front surface; inserting a part of the rear portion of the fiber bundle into the plurality of the small holes of the heating platen; heating the heating platen to melt the rear end portion of the fiber bundle; cooling the heating platen to solidify the thus melted rear portion of the fiber bundle, whereby a predetermined thickness flange provided with at least one projection at its rear surface and a fibrous part at its front surface is formed, which projection has a predetermined length and is easily elastically deformable.

BRIEF DESCRIPTION OF THE DRAWINGS

FIGS. 1-A, 1-B and 1-C are schematic views illustrating the steps of a method for producing the brush tip of the present invention;

DESCRIPTION OF THE PREFERRED EMBODIMENTS

Figure 2:
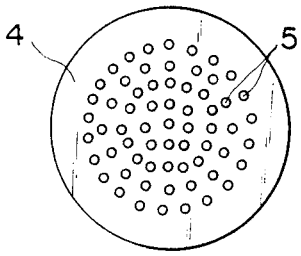
FIG. 2 is a rear view of an embodiment of the brush tip of the present invention.
Figure 3:
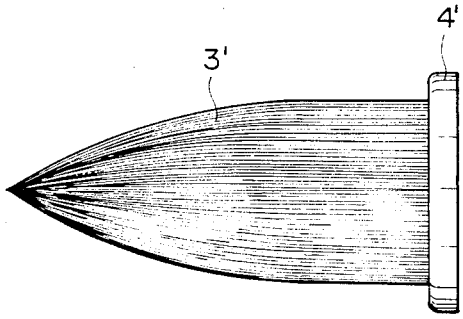
FIG. 3 PRIOR ART
FIG. 3 is a side view of a conventional brush tip.

Hereinbelow, the present invention will be described in detail with reference to the accompanying drawings. However, it is clear that the present invention is not limited to the embodiments of the present invention shown in the drawings.

FIGS. 1-A, 1-B and 1-C are schematic views illustrating the steps of the method for producing the brush tip of the present invention. As shown in FIG. 1-A, a heating platen 2 having a smooth surface is provided with a plurality of small holes 1 at its front surface on which is abutted a rear portion of a fiber bundle 3 made of synthetic resins such as PETP and like plastics. Then, as shown in FIG. 1-B, a part of the rear portion of the fiber bundle 3 is inserted into the plurality of the small holes 1 of the heating platen 2 and heated in such condition to the melted and welded, and thereafter cooled to be solidified, so that a flange 4 having a predetermined thickness is formed at the rear end portion of the brush tip while a plurality of needle-like projections 5 are formed in rear surface of the flange 4, which projections 5 are therefore positioned in a side opposite to a side where a fibrous part of the brush tip is positioned as to the flange 4. The thus completed brush tip assumes a form a side view of which is shown in FIG. 1-C.

In working the method of the present invention, melting, welding, cooling and solidifying steps of the fiber bundle by the use of the heating platen and the like may be conducted in the same manner as that of a conventional method.

FIG. 2 is a rear view of the thus produced brush tip of the present invention.

It is possible to change the projections 5 in number, length, thickness, configuration and the like thereof at will by changing the small holes 1 of the heating platen 2 in number, depth, diameter, configuration and the like.

The brush tip of the present invention may be made of a conventional material.

Since the brush tip of the present invention has the above construction, it is possible to supplement a shortage of the thickness of the flange 4 of the brush tip of the present invention even when such shortage is produced, to lead to a firm fixing of the brush tip of the present invention in the liquid applicator.

In addition, as for the method of the present invention, there is no difference between the present invention and the prior art except a special effect produced by the configuration of the heating platen 2 of the present invention, so that the complicated configuration of the brush tip of the present invention does not add to cost.

What is claimed is:

1. A one-piece brush tip for a liquid applicator comprising:

a shaped bundle of synthetic resin fibers having a tip portion and a rear portion, said tip portion being shaped to a tapered point to apply liquid supplied to said resin fibers, said rear portion being shaped as a flange having a predetermined thickness and a diameter greater than a majority of said shaped bundle, and a plurality of spaced conical projections integrally provided on and protruding from said flange portion in a direction opposite to said tip portion, said projections being easily elastically deformable so as to allow a secure connection of said flange portion to the liquid applicator.

* * * * *